United States Patent [19]

Raasch

[11] Patent Number: 4,693,070

[45] Date of Patent: Sep. 15, 1987

[54] THREAD JOINING APPARATUS FOR AN OPEN END SPINNING MACHINE

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 919,198

[22] Filed: Oct. 15, 1986

[30] Foreign Application Priority Data

Oct. 16, 1985 [DE] Fed. Rep. of Germany ..... 3536910

[51] Int. Cl.[4] ..... D01H 15/00; D01H 13/22

[52] U.S. Cl. ..... 57/263; 57/306

[58] Field of Search ..... 57/261, 263, 264, 22, 57/300, 301, 304, 306

[56] References Cited

U.S. PATENT DOCUMENTS

| | | | |
|---|---|---|---|
| 4,080,775 | 3/1978 | Stahlecker | 57/263 |
| 4,132,056 | 1/1979 | Husges et al. | 57/263 |
| 4,159,616 | 7/1979 | Takeuchi et al. | 57/263 X |
| 4,178,749 | 12/1979 | Stahlecker et al. | 57/263 X |
| 4,223,517 | 9/1980 | Husges et al. | 57/306 X |
| 4,541,235 | 9/1985 | Raasch | 57/263 |
| 4,559,773 | 12/1985 | Stahlecker | 57/261 |
| 4,598,539 | 7/1986 | Stahlecker et al. | 57/301 X |

*Primary Examiner*—Donald Watkins

*Attorney, Agent, or Firm*—Herbert L. Lerner; Laurence A. Greenberg

[57] ABSTRACT

An automatic thread joining apparatus for an open end spinning machine includes a device for producing a tension-proof thread connection forming a thread joint, a device for removing the thread joint, a controllable thread storage device for intermediate storage of a length of thread spun during operation of the device for producing a tension-proof thread connection, and a thread removal device associated with the thread storage device being activated upon the occurrence of an unsuccessful thread connecting operation.

5 Claims, 3 Drawing Figures

THREAD JOINING APPARATUS FOR AN OPEN END SPINNING MACHINE

The invention relates to an automatic thread joining or piecing apparatus for an open end spinning machine, provided with a device for producing a tension or strain-proof thread connection, a device for removing the joint or piecer, and a controllable thread storage device for the temporary storage of a length of thread spun during the connection operation.

German Published, Non-Prosecuted Application DE-OS No. 33 18 687, corresponding to U.S. Pat. No. 4,541,235 describes a method for the tension-proof joining of a thread prior to its transfer to a thread collecting point, to a thread already located in the collecting point and a method of delivering the continuously spun thread to a thread storage device during the formation of the thread connection. Once the thread connection has been made, the contents of the thread storage device are delivered to the thread collecting point in an accelerated manner. However, if an unsuccessful attempt at making a thread connection has been made, it is very difficult and time-consuming to make another attempt at the thread connection.

It is accordingly an object of the invention to provide a thread joining apparatus for an open end spinning machine, which overcomes the hereinafore-mentioned disadvantages of the heretofore-known devices of this general type and to enable a new thread connecting operation to take place quickly and simply following an unsuccessful thread connecting operation.

With the foregoing and other objects in view there is provided, in accordance with the invention, an atomatic thread joining or piecing apparatus for an open end spinning machine, comprising a device for producing a tension or strain-proof thread connection forming a thread joint or piecer, a device for removing the thread joint, a controllable thread storage device for intermediate storage of a length of thread spun during operation of the device for producing a tension-proof thread connection, a thread removal device associated with the thread storage device, and means for activating the thread removal device upon the occurrence of an unsuccessful thread connecting operation. Once the thread has been removed, the thread storage device is again ready for a new thread connecting operation. It is optional as to whether or not a new joining operation is then performed, but it is appropriate. In principle, the spinning apparatus can continue to operate; however, in that case the spun thread is delivered to a waste collector until such time as the thread storage device is again in operation.

In accordance with another Feature of the invention, the thread removal device is disposed between the thread storage device and the device for producing a tension-proof thread connection. A thread removal device disposed in this way is not only capable of removing thread located in the thread storage device, but can also remove the thread extending toward the device for producing a tension-proof connection.

In accordance with a further feature of the invention, the means for activating the thread removal device includes a thread monitor or monitor disposed downstream of the device for producing a tension-proof thread connection. If the sensor detects the presence of the thread after a tension-proof thread connection has been made, then this is an indication that the thread connection has been successful.

On the other hand, if the thread sensor detects the fact that the thread is not present after the connecting operation, it activates the thread removal device, which then immediately pulls the thread out of the thread storage device and optionally out of the thread connecting device as well, so as to thereby enable a new joining operation or at least a new thread connecting operation to take place.

In accordance with an added feature of the invention, the thread removal device includes a rotatable thread draw-off device. This may, for instance, be a thread collecting drum. However, it may also be a rotating pair of rollers which merely pulls the thread out of the thread storage device and then delivers it to a particular waste receptacle.

In accordance with a concomitant feature of the invention, the thread removal device includes a device for generating a flow carrying the thread along. For instance, such a device may include a nozzle configuration aimed at wound-up thread layers of the thread storage device, with the aid of which the thread can be blown away from a storage drum. However, the device may also include a suction tube or an injection tube, in which a flow is generated by the injection of compressed air and this flow then carries the thread along with it. Such devices may be present in addition to a rotatable yarn retractor device.

Other features which are considered as characteristic for the invention are set forth in the appended claims.

Although the invention is illustrated and described herein as embodied in a thread joining apparatus for an open end spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
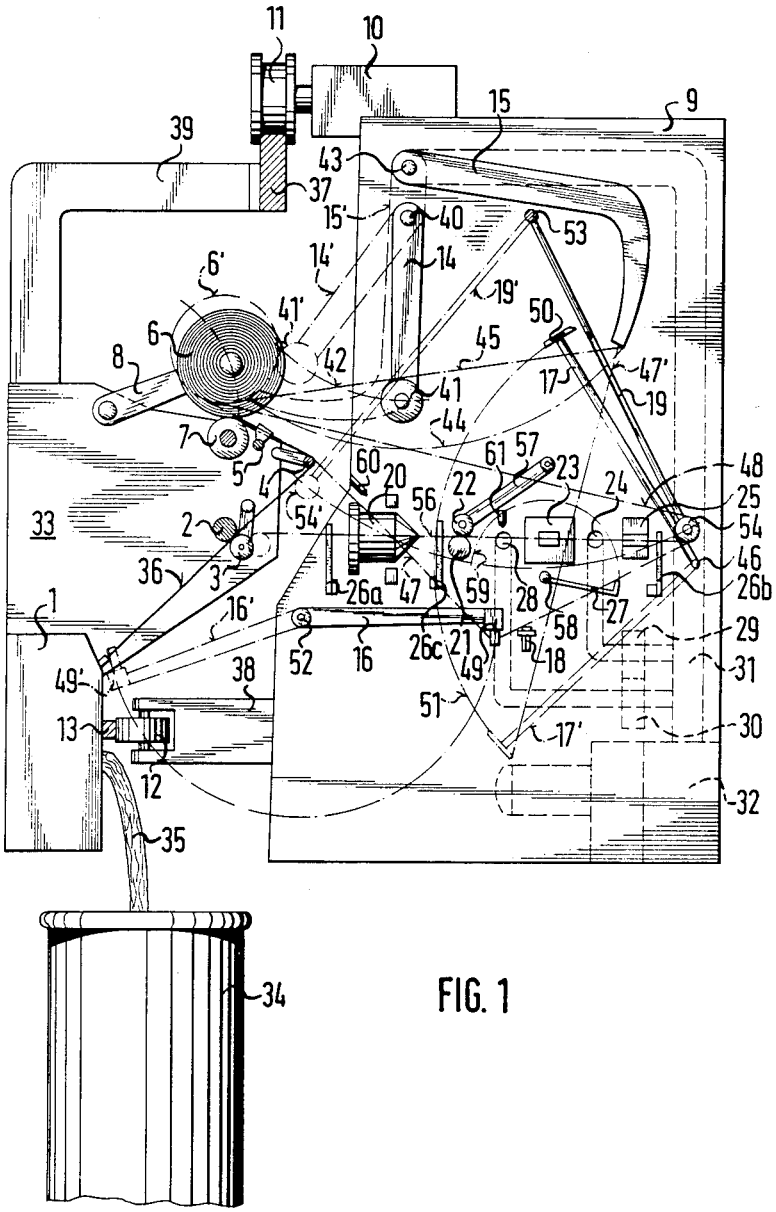
FIG. 1 is a fragmentary, diagrammatic, side-elevational view of an automatic thread piecing apparatus according to the invention.

Referring now to the figures of the drawings in detail and first, particularly, to FIG. 1 thereof, it is seen that sliver 35 is drawn from a can 34 and delivered to a spinning box 1 at a spinning station 33 of an open end spinning machine. Thread is spun in the spinning box 1 and follows a path indicated by reference numeral 36 during the spinning operation. The thread is drawn out of the spinning box 1 at a constant speed, with the aid of a draw-off or unwinding shaft 2, against which a pivotally suspended draw-off roller 3 can be placed. The thread travels over a deflector wire 4 and a thread guide 5 to a cross wound bobbin or cheese 6. The cross-wound bobbin 6 rests on a lap or winding roller 7. The lap roller 7 drives the cross-wound bobbin 6 by friction.

The cross-wound bobbin 6 is held and guided by a bobbin frame or creel 8.

An automatic thread joining or spinning starting apparatus 9 is provided with a traveling mechanism 10 having traveling rollers 11 which are guided by a rail 37. The automatic thread joining apparatus 9 is supported on support rails 13 with the aid of support rollers 12, which are located on cross bars 38. The support rails 13 are located on housings of the spinning boxes 1. The rails 37 are connected to spinning stations 33 by means of cross bars 39.

A bobbin driving arm 14 which is pivotable about a pivot point 40, has a roller 41 which is drivable by means of a non-illustrated indexable drive mechanism. The bobbin driving arm 14 can be pivoted into a position 14' shown in phantom by means of a non-illustrated pivoting device, while the roller 41 moves along a circular are 42 into a position 41' which is also shown in phantom. The cross-wound bobbin 6 is therefore raised from the lap roller 7 and moved into a position 6' shown in phantom. The non-illustrated roller drive mechanism can selectively turn the roller 41 forward and backward, so that the roller 41 is capable of rotating the bobbin 6 both in the winding direction and counter to the winding direction while in its raised state, by means of friction.

A suction nozzle 15 which can be subjected to negative pressure, can be pivoted about a pivot point 43 out of the position shown in solid lines into a position 15' shown in phantom. In this position, the suction nozzle 15 which is subjected to negative pressure is then capable of seeking an end of a thread on top of the bobbin 6 and aspirating it. After the aspiration of the end of the thread, the mouth of the suction nozzle 15 pivots along a circular are 44 back into its initial position and carries the thread with it, along a path indicated by reference numeral 45. Susequently, a retractor 17 can be pivoted about a pivot point 46 from the position shown in solid lines to a position 17' shown in phantom. In so doing, it carries the thread with it, which therefore follows a path 47 in the direction toward the bobbin 6 and a path 47' in the direction toward the suction nozzle 15. While a driver 50 of the retractor 17 describes a circular arc 51, the thread path 47 enters the vicinity of a clamp 49 of a feeder 16. The feeder 16 is pivotable about a pivot point 52 from the position shown in solid lines into a position 16' shown in phantom.

While the driver 50 moves along the circular arc 51, the thread path 47 also enters the vicinity of controllable scissors 18.

A transfer device 19 is pivotable about a pivot point 53, from a position 19' shown in phantom as far as the position shown in solid lines. A roller 54 is disposed at the lower end of the transfer device 19. The operation of the transfer device 19 will be explained below.

As soon as the thread has taken the path 47, the scissors 18 are actuated. The severed piece of thread, indicated by the thread path 47, is aspirated into the suction nozzle 15. The thread end that is firmly held by the clamp 49 can then be brought in front of a draw-off tube of the spinning box 1 due to the pivoting of the feeder 16 into the position 16' shown in phantom. In so doing, the thread moves from the thread path 47 into contact with the roller 54, which is in the position 54', and arrives behind the draw-off roller 3 which has pivoted away from the draw-off shaft 2. As soon as the transfer device 19 is pivoted out of the position 19' into the position shown in solid lines, its roller 54 carries the thread 56 with it, which thereby takes the thread path as shown in the lower portion of its thread loop. Beginning at the clamp 49, which is then in the position 49, the thread passes over the draw-off roller 3, past a thread storage device 20, a thread connector 23 and a thread monitor or sensor 25 to the roller 54 of the transfer device 19, which has pivoted toward the right, and from there it follows the thread path 48 and extends to the bobbin 6. The thread 56 also leads past a pair of draw-off rollers, including a draw-off shaft 21 and a clamping roller 22 which can be placed against the draw-off roller 21 by means of a pivoting arm 57, but at this time is supposed to be raised, unlike the illustration of FIG. 1. The thread 56 also leads past suction tubes 24 and 28. The suction tubes 24 and 28 are located to the right and left of the thread connector 23. The pair of draw-off rollers 21, 22 is disposed between the thread storage device 20 and the thread connector 23.

Three thread inserters or regulators **26*a*, 26*b* and 26*c* can be seen in FIG. 1 below the thread 56. The thread inserters can be pivoted upward from an approximately horizontal position into the vertical position shown. The thread inserter 26*a* is located to the left of the thread storage device 20, the thread inserter 26*b* is located to the right of the thread monitor 25, and the thread inserter 26*c* is located to the right of the thread storage device 20**.

The two suction tubes 24 and 28 communicate with a suction device 32, from which a suction tube 31 branches off. The suction tube 31 also communicates with the suction nozzle 15 and with two switchable valves 29 and 30. The suction tube 24 can be subjected to a vacuum with the aid of the valve 29, and the suction tube 28 can be subjected to a vacuum with the aid of the valve 30.

FIG. 1 also shows a thread gripper 27 which is pivotable about a pivot point 58 and is capable of grasping the thread between the suction tube 24 and the thread monitor 25 and inserting it into the thread connector 23. In so doing, the end of the thread gripper 27 describes a circular arc 59.

As soon as the thread inserters **26*a*, 26*b*, and 26*c* pivot upward as shown in FIG. 1, the thread is presented to the thread storage device 20, inserted between the draw-off roller 21 and clamping roller 22, inserted into the thread connector 23 and presented to the thread monitor 25**.

The thread storage device 20, which in principle is constructed as described in co-pending U.S. application Ser. No. 860,677, filed May 7, 1986, is shown in particular in FIGS. 2 and 3.

A thread guide 201 of the thread storage device 20 which is constructed as a rotationally symmetrical body, is supported on supporting means in the form of support roller configurations **2*a*, 2*b* and 2*c* which are distributed about the feriphery. The support roller configuration each include four support rollers 226 and 227, which are rotatably supported in a machine frame 203**.

Figure 3:
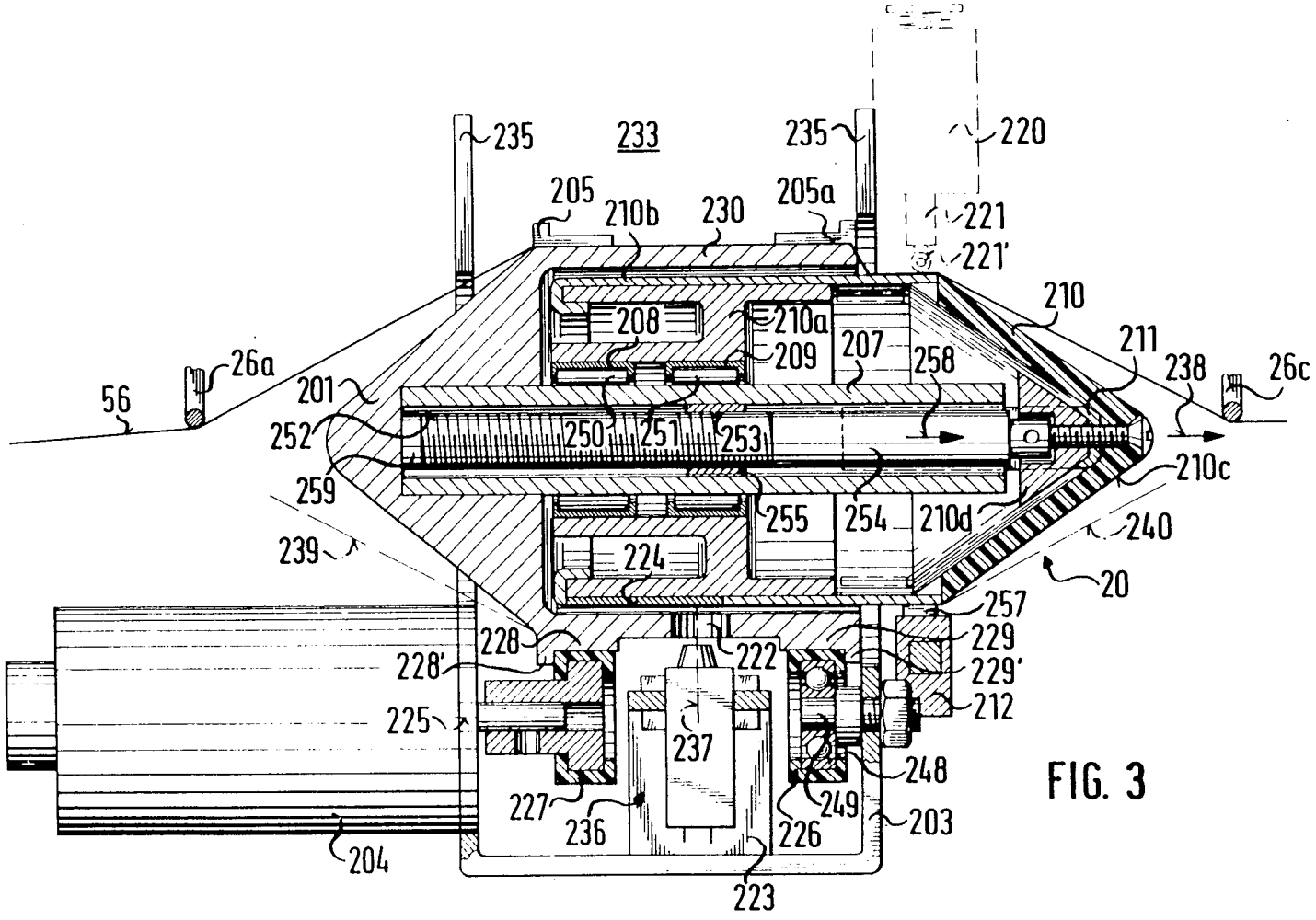
FIG. 3 is a longitudinal-sectional view of the thread storage means, taken along the line III—III in FIG. 2, in the direction of the arrows.

According to FIG. 3, each support roller 226 is supported by means of a roller bearing 248 on a shaft 249 secured to the machine frame 203.

A pivot shaft 225 of the support roller 227 that is shown in FIG. 3 is connected to a drive motor 204. With the drive motor 204 running, the support roller 227 drives the thread guide 201 by frictionally engaging a tube-like end section 230 thereof which partly fits over a storage drum 210. The storage drum 210 is substantially formed of a core 210*a*, a jacket 210*b*, a head 210*c* and an insert 210*d*.

A hollow central shaft 207 is screwed to the body 201. The shaft 207 has bearings 208, 209 for the storage drum 210. Rollers 250, 251 of the bearings, constructed as roller bearings, are capable of rolling on the shaft 207 and are supported in such a way that they are longitudinally displacable. The shaft 207 also has a displacement device, including an element 254 which is connected to the storage drum 210 and has an axially symmetrical thread 252, and an element 255 connected to the thread guide 201, the element 255 being provided with an axially symmetrical thread 253 which fitts and meshes with the thread 252 of the first element 254. The element 254 of the storage drum 210 includes a threaded rod which meshes with the female thread 253 of the second element 255, which is in the form of an inserted threaded tube and is a component of the hollow shaft 207 of the thread guide 201.

The element or threaded rod 254 is screwed to the storage drum 210.

The support rollers 226, 227 roll on runner rings or threads 228, 229 of the tube-like end section 230 of the body 201. The runner rings 228, 229 are provided with radially open thread guide slits 205, 205*a*. For better guidance of the support rollers, the runner rings 228, 229 have flange rings 228', 229'.

The stabilized location of the storage drum 210 is assured by means of magnetic forces, which act between an element 212 disposed in a stabilized manner on the machine frame 203 and an element 211 disposed on the storage drum 210. The element 212 disposed in a stabilized manner on the machine frame 203 is in the form of an electromagnet, having poles

Figure 2:
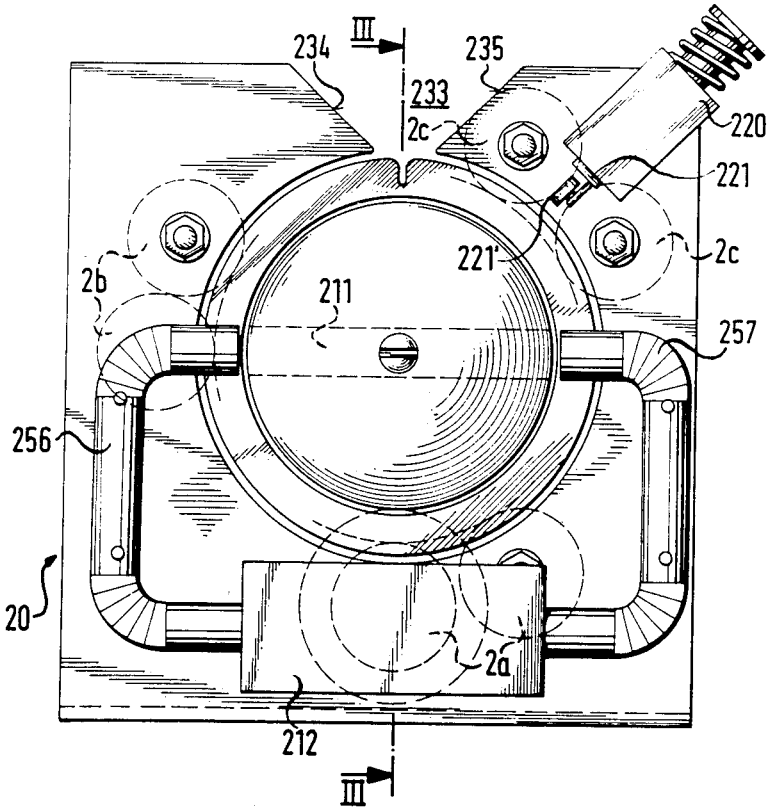
FIG. 2 is an enlarged, front-elevational view of thread storage means of the thread piecing apparatus of FIG. 1.

256, 257 which are offset by 180° from one another, which face one another, and are spaced apart with respect to the storage drum 210, as shown in FIG. 2. The element 211 disposed on the storage drum 210 is constructed in the form of a strip of soft iron which extends from a point opposite one pole 256 of the first element 212 up to a point opposite the other pole 257 of the first element 212.

As shown in FIGS. 2 and 3, a switchable or indexable thread holding device 220 is connected to the machine frame 203. This device includes an electromagnet drive mechanism, having a push rod or tappet 221 which is provided with a roller 221' and can be moved forward as far as the surface of the storage drum 210 when the electromagnetic drive mechanism is switched on. In FIG. 3, the thread holding device 220 is shown in phantom because it is actually located at a much lower location in the sectional illustration.

The electromagnetic drive mechanism 220 is electrically connected in parallel to the electromagnet of the element 212 which assures the stabilized location of the storage drum 210.

A special threading and unthreading position 233 is provided on the machine frame 203. This position has thread guide contours 234 and 235. The thread guide contours are spread apart in funnel-like fashion, widening toward the outside, and they guide a thread 56 into the thread guide slits 205, 205*a* if the thread guide 201 is in its zero or off position. This is always the case whenever the thread guide slits 205, 205a are located at the threading position 233. Otherwise the thread 56 is first caused to rest against the flange rings 228', 229' by the thread guide contours 234, 235 and only then, because of the rotation of the body 201, is the thread automatically introduced into the thread guide slits 205, 205*a*.

In order to adjust the thread guide 201 into its zero position, a zero setting device generally identified by reference numeral 236 in FIG. 3 is provided. The zero setting device 236 has a sensor 223 that controls the drive motor 204 of the support roller 227. The sensor 223 responds to a marking 222 of a particular kind which is provided on the thread guide 201.

Since the sensor 223 is in the form of a reflecting light barrier or electric eye in the illustrated embodiment, the marking 222 mentioned above is in the form of an opening in the tube-like end section 230 of the thread guide 201. The optical axis 237 of the reflecting light barrier 223 is aimed through the opening 222 at a reflector strip 224 secured to the storage drum 210.

The reflecting light barrier 223 has a non-illustrated operative connection with the drive motor 204. In response to a control command to establish the zero position, the reflecting light barrier 223 acts upon the drive motor 204 by means of control signals which bring about forward travel, or alternating forward travel and reverse travel, until such time as the optical axis 237 strikes the reflector strip 224. The thread guide slit 205 is in the zero position in front of the threading position 233, as shown in FIGS. 2 and 3.

FIG. 3 shows the storage drum 210 in the inserted state. If it is held firmly by magnetic forces while the thread guide 201 rotates, then its threaded rod 254 unscrews out of the female thread 253 in the direction of the arrow 258. If the pitch of the screw thread is equal to or greater than the thickness of the thread being spun, the windings are placed alongside each other on the storage drum 210.

A storage operation will now be described in greater detail, referring to FIG. 3.

The thread 56 delivered by the thread inserters 26*a*, 26*c* first travels through the thread storage device 20, without being stored there. With the thread guide 201 at rest, first the thread holding device 220 is actuated for preparing for storage, so that the push rod 221, which has the roller 221' on one end thereof, is moved forward as far as the surface of the storage drum 210, as shown in FIG. 3. At the same time the electromagnet 212 is switched on. The thread 56 has previously passed through the threading position 233 and entered the thread guide slits 205, 205*a*. The drive motor 204 then sets the thread guide 201 into operation. The thread is capable of extending as far as the push rod 221 without winding about the storage drum. The thread is stopped at the push rod 221 and the thread begins to wind up on the storage drum no later than this point in time.

The thread is then continuously carried along through the thread guide slits 205, 205*a* and thereby forms a thread balloon 239 on a feeding or entry side. During the storage process, the storage drum 210 moves in the direction of the arrow 258 out of the tube-like end section 230 of the thread guide 201. Once the desired number of windings, or a maximum possible number of windings has been stored, the drive motor 204 is shut off. At the same time the thread holding device 220 and the electromagnet 212 are switched off. The thread 56 is drawn off over the head or end of the storage drum 210, through the thread guide element 219, in the drawing-off direction 238, forming a thread balloon 240 on the outlet side. Once the thread storage device has been emptied, the drive motor 204 is switched to reverse operation and switched on again until such time as the threaded rod 254 has screwed back into its basic position shown in FIG. 3.

If the drive motor should coincidentally travel too far in the forward direction, a collar 259 provided on the end of the threaded rod 254 prevents the threaded rod from rotating all the way out of the female thread 253.

If the thread 56 is to be withdrawn from the thread storage device once again, after all of the stored windings have been used up all that needs to be done is to put the thread guide 201 initially into its zero position and then pivot the thread inserters 26*a*, 26*b* back into position.

Since FIG. 3 shows the thread storage device 20 rotated through 45°, the thread inserters 26*a*, 26*b* in actuality do not operate above, but rather in front of, the thread storage means 20.

The thread joining operation is performed in the following manner by the automatic thread joining apparatus 9:

If the thread joining apparatus 9 is required by the spinning station 33, it moves in front of the spinning station by means of a non-illustrated detent device and into the thread joining position shown in FIG. 1. In the meantime the spinning operation has been discontinued.

In order to begin the spinning operation again, the thread must first be recovered from the bobbin or cheese 6. To this end, the bobbin driving arm 14 pivots into the position 14'. The roller 41 thereby lifts the bobbin 6 from its lap roller 7 and moves it into the position 6'. The roller 41 rotates the bobbin 6 counter to the winding-on direction. The suction nozzle 15 pivots against the bobbin 6 and aspirates the end of the thread. In the meantime the transfer device 19 has pivoted forward as well. After the aspiration of the end of the thread, the suction nozzle 15 pivots counter clockwise into its initial position and pulls a thread fiber from the bobbin 6 as far as the mouth of the suction nozzle 15, as indicated by the thread path 45.

The driver 50 of the retractor 17 is shaped in such a way that it is capable of traveling past the thread fiber whenever the retractor 17 pivots upward out of a middle position into the position shown in solid lines. On the other hand, when the retractor 17 pivots downward into the position 17' indicated in phantom, the driver 50 grasps the thread and pulls it downward in a loop-like fashion. During this process, one leg of the loop slides past the feeder 16, that is, past the clamp 49 thereof and past the scissors 18. If the retractor 17 is then pivoted into a middle position, in which it is located approximately horizontally, then the thread from the bobbin 6 is made taut by the clamp 49 of the feeder 16 and extends through the scissors 18 to the suction nozzle 15. The scissors 18 therefore cut the thread and the remainder of the thread is aspirated into the suction nozzle 15. The feeder 16 then pivots into the phantom position 16', as a result of which the end of the thread arrives directly in front of the draw-off tube of the spinning box 1.

It has already been mentioned that as a result of this operation, the thread wraps around the roller 54 of the transfer device 19. The bobbin 6 is then driven backward once again by means of the bobbin driving arm or its roller 41 and the transfer device 19 then pivots counter clockwise into its right-hand position. As a result the transfer device pulls a loop of thread which has a lower leg that passes over the draw-off roller 3 which is pivoted away from the draw-off shaft 2, and as already noted the thread 56 follows a path leading it past the thread storage device 20, the draw-off roller 21, the thread connector 23 and the thread monitor 25, while the upper leg of the loop of the thread extends in an approximately straight line from the bobbin 6 to the roller 54 of the transfer device 19, designated as the thread path 48.

The thread inserters 26*a*–26*c* then bring the thread into the grasping range of the thread storage device 20, between the draw-off roller 21 and the clamping roller 22, into the suction range of the suction tube 28, into the operative range of the thread connector 23 or its thread holding devices, into the suction range of the suction tube 24 and into the operative range of the thread monitor 25. After the pivot arm 57 has pivoted downward, the clamping roller 22 presses against the thread located on the draw-off roller 21.

Since the draw-off roller 21 travels backward and the clamp 49 releases the end of the thread, the end of the thread is aspirated into the draw-off tube of the spinning box 1.

If the spinning box has a rotor that is already rotating, the end of the thread is moved back as far as the rotor slot and the feeding of filaments into the rotor is begun at the same time by means of a non-illustrated switch. The actual thread joining operation takes place by joining the end of the thread to the fiber ring collecting in the rotor. The direction of rotation of the draw-off roller 21 is subsequently reversed and the thread is pulled out of the spinning box 1. The valve 30 for the suction tube 28 is then closed while the valve 29 for the suction tube 24 is opened. The thread drawn off by the draw-off roller 21 and clamping roller 22 is then aspirated into the suction tube 24. During this process, the thread travels through the thread connector 23, which may be constructed as a splicing device, for instance.

The thread coming from the bobbin 6 must also be inserted into the thread connector 23. To this end, the thread gripper 27 grasps the thread between the thread monitor 25 and the suction tube 24 and also inserts it into the thread connector 23 by means of a pivoting movement. During this time, the thread supplied by the draw-off roller 21 continues to travel into the suction tube 24. If both ends of the thread are ready so that the thread connection can be made, and if it is also assured that the joint, which may for instance be perceptible as a nib, slub or thickening, is aspirated into the suction tube 24, then the clamping roller 3 is moved against the draw-off roller 2 of the spinning station 33, so that the drawing off of the the thread is effected by the spinning station 33 itself. The pivot arm 57 is then pivoted upward once again, so that the clamping roller 22 is lifted from the draw-off roller 21. At the same time, the thread storage device 20 begins to operate, so that the drive motor 204 seen in FIG. 3 is switched on, for instance. The moving thread 56 is placed against the storage drum 210 in the manner described above and is wound onto the storage drum.

From the moment at which the storage of the thread begins, the threads located alongside one another in the thread connector 23 are at a standstill, and the joining of the thread can be performed with the threads stopped. The valve 29 is closed and the valve 30 is opened, so that a vacuum prevails at the suction tube 28. Once the thread connection has been made, in the course of which excessively long thread ends are automatically served in the thread connector, the bobbin driving arm 14 or its roller 41 drives the bobbin 6 in the wind-up direction at an increased winding speed and the thread storage device 20 is once again emptied by drawing off of thread over the head or end. As soon as the thread storage device has been emptied, the transfer device 19 is drawn toward the spinning station 33, against the force of a non-illustrated spring, by means of the still-elevated wind-up speed. During this process, the thread guide 201 of the thread storage device 20 is moved into the unthreading position and is stopped, and the thread inserters 26*a*, 26*b*, 26*c* pivot back into their initial positions. As soon as the transfer device 19 has arrived at the forward position, the bobbin driving speed of the roller 41 is switched over to normal speed, and the thread has reached a position in which it can be grasped by the thread guide 5, whereupon it is pulled away to the side by the roller 54 as a result of the movement of the thread guide. The bobbin 6 drops back down onto the lap roller 7 by pivoting back the bobbin driving arm 14, so that it is once again driven by the lap roller 7. The thread piecing operation is thus ended.

However, if the thread connecting operation has been unsuccessful, the thread detector 25 detects the fact that there is no longer a thread present. the non-illustrated operative connection between the automatic joining appartus 9 and the thread feeding apparatus of the spinning box 1 is interrupted, so that the feeding of the thread stops. The result is a thread break. At the same time, the thread monitor 25 initiates the use of a thread removal apparatus which includes the draw-off roller 21 and the clamping roller 22, as well as the suction tube 28. The clamping roller 22 is seated on the draw-off roller 21, so that the length of thread contained in the thread storage device 20 is drawn out over the end or head of the thread storage device 20 is and picked up by the suction tube 28 behind the draw-off roller pair 21, 22, since the suction tube 28 is subjected to a vacuum. Furthermore, the thread monitor 25 causes the remaining operating elements of the thread joining apparatus 9 to return to their initial positions. After the thread storage device 20 has beem emptied, a new attempt at joining the threads can be started immediately, in the manner described above.

The invention is not intended to be limited to the embodiment shown and described herein.

For instance, the thread storage device 20 may be equipped with blow nozzles 60, shown in FIG. 1, which are subjected to compressed air so as to blow the layers of thread downward from the storage drum of the thread storage device for removing the thread. Alternatively, the suction tube 28 can also cooperate with blow nozzles 61, which are subjected to compressed air, so as to bring about a forced injection air flow through the suction tube 28, which may under some circumstances suffice to pull the thread out of and empty the thread storage device 20.

Alternatively, the thread storage device may advantageously be constructed as described in co-pending U.S. application Ser. No. 860,676, filed May 7, 1986. In a thread storage means of this kind, the stored layers of thread are pushed forward by means of a wobble plate on the storage drum.

The foregoing is a description corresponding in substance to German Application No. P 35 36 910.8, dated Oct. 16, 1985, the International priority of which is being claimed for the instant application, and which is hereby made part of this application. Any material discrepancies between the foregoing specification and the aforementioned corresponding German application are to be resolved in favor of the latter.

I claim:

1. Automatic thread joining apparatus for an open end spinning machine, comprising a device for producing a tension-proof thread connection forming a thread joint, a device for removing the thread joint, a controllable thread storage device for intermediate storage of a length of thread spun during operation of said device for producing a tension-proof thread connection, a thread removal device associated with said thread storage device, and means for activating said thread removal device upon the occurrence of an unsuccessful thread connecting operation.

2. Automatic thread joining apparatus according to claim 1, wherein said thread removal device is disposed between said thread storage device and said device for producing a tension-proof thread connection.

3. Automatic thread joining apparatus according to claim 1, wherein said means for activating said thread removal device includes a thread monitor disposed downstream of said device for producing a tension-proof thread connection.

4. Automatic thread joining apparatus according to claim 1, wherein said thread removal device includes a rotatable thread draw-off device.

5. Automatic thread joining apparatus according to claim 1, wherein said thread removal device includes a device for generating a flow carrying the thread along.

* * * * *